US011376603B2

(12) United States Patent
Gomez

(10) Patent No.: US 11,376,603 B2
(45) Date of Patent: Jul. 5, 2022

(54) DEPACKAGING APPARATUS WITH IMPROVED CLEANING

(71) Applicant: GREEN CREATIVE, Sucy en Brie (FR)

(72) Inventor: Rémi Gomez, Paris (FR)

(73) Assignee: GREEN CREATIVE, Sucy en Brie (FR)

( * ) Notice: Subject to any disclaimer, the term of this patent is extended or adjusted under 35 U.S.C. 154(b) by 239 days.

(21) Appl. No.: 16/646,803

(22) PCT Filed: Sep. 11, 2018

(86) PCT No.: PCT/EP2018/074505
§ 371 (c)(1),
(2) Date: Apr. 30, 2020

(87) PCT Pub. No.: WO2019/053018
PCT Pub. Date: Mar. 21, 2019

(65) Prior Publication Data

US 2020/0298246 A1 Sep. 24, 2020

(30) Foreign Application Priority Data

Sep. 12, 2017 (FR) ..... 17 58450

(51) Int. Cl.
*B02C 17/18* (2006.01)
*B02C 17/00* (2006.01)
*B02C 17/02* (2006.01)

(52) U.S. Cl.
CPC ..... *B02C 17/18* (2013.01); *B02C 17/007* (2013.01); *B02C 17/02* (2013.01)

(58) Field of Classification Search
CPC ..... B02C 17/007; B02C 17/18; B07B 1/22; B07B 1/52
USPC ..... 241/166–167
See application file for complete search history.

(56) References Cited

U.S. PATENT DOCUMENTS 1,358,002 A * 11/1920 Lash ..... A23N 15/12 99/636
1,866,877 A * 7/1932 Campen ..... B07B 13/003 209/616
4,469,230 A * 9/1984 Gorlitz ..... B07B 1/54 209/683
4,927,528 A * 5/1990 Doppstadt ..... B07B 9/00 209/31

(Continued)

FOREIGN PATENT DOCUMENTS

DE 202 14 115 U1 3/2004
FR 2 676 186 A1 11/1992

(Continued)

*Primary Examiner* — Faye Francis
(74) *Attorney, Agent, or Firm* — Muncy, Geissler, Olds & Lowe, P.C.

(57) ABSTRACT

Processor apparatus for collecting material adhering to surfaces of packages for processing as waste. The processor apparatus includes a cylindrical drum that is rotatable about a longitudinal axis and provided with orifices to form a screen that retains the packages while allowing the material for collecting to pass through; and motor device for driving the rotary drum in rotation. The processor apparatus also includes an unclogging device for at least partially unobstructing the orifices while the cylindrical drum is rotating.

15 Claims, 10 Drawing Sheets

(56) References Cited

U.S. PATENT DOCUMENTS

| | | | | | |
|---|---|---|---|---|---|
| RE34,458 | E * | 11/1993 | Fahrenholz | B02C 17/002 | 209/234 |
| 6,666,395 | B2 * | 12/2003 | Cavalieri | B26D 3/185 | 241/167 |
| 6,955,265 | B2 * | 10/2005 | Tse | B65B 69/0041 | 209/683 |
| 7,383,956 | B2 * | 6/2008 | Freeman | B07B 1/22 | 209/284 |
| 7,497,337 | B2 * | 3/2009 | Tse | B02C 17/007 | 209/294 |
| 8,127,668 | B2 * | 3/2012 | Snyder, Jr. | A23N 15/025 | 99/636 |
| 8,757,524 | B2 * | 6/2014 | Mosman | A01G 3/00 | 241/30 |
| 9,161,566 | B2 * | 10/2015 | Hall | B26D 1/36 | |
| 9,636,838 | B2 * | 5/2017 | Evans | B26D 7/2614 | |
| 10,226,793 | B2 * | 3/2019 | Gomez | B65B 55/24 | |
| 11,097,282 | B2 * | 8/2021 | Hall | B02C 23/18 | |
| 2007/0119755 | A1 * | 5/2007 | Freeman | B03C 3/80 | 209/284 |

FOREIGN PATENT DOCUMENTS

| | | | |
|---|---|---|---|
| FR | 3 028 779 | A1 | 5/2016 |
| WO | WO 2007/042926 | A1 | 4/2007 |

* cited by examiner

DEPACKAGING APPARATUS WITH IMPROVED CLEANING

FIELD OF THE INVENTION

The invention relates to sorting waste, in particular for the purposes of recycling or disposal. The invention relates more particularly to a device for cleaning packages in the context of reprocessing waste, in particular waste from supermarkets.

BACKGROUND OF THE INVENTION

In the field of processing waste, in particular waste from supermarkets, processor apparatus is known for collecting the material adhering to the outside surfaces of packages for processing. Such an apparatus is shown in accompanying FIG. 1.

That apparatus 1 comprises a cylindrical drum 4 that is rotatable about a longitudinal axis Ox and that is provided with orifices 6 to form a screen that retains the packages while allowing the material for collecting to pass through, motor means 12 for driving the cylindrical drum 4 in rotation, and an outer casing 3 for collecting the material that has come from the packages 13 inserted into the cylindrical drum 4 and that has passed through the wall of the cylindrical drum 4. Optionally, a rotary brush 7, likewise driven in rotation by the motor means 12, may be mounted in the cylindrical drum 4 in order to brush the inside surface of the drum.

Thus, when a package 13 is inserted into that apparatus 1, it is caught by the brush 7 so as to be brushed and taken into the contact zone where the brush makes contact with the inside surface of the cylindrical drum 4, in which zone the package is subjected to intense brushing. This has the effect of removing the materials adhering to the surface of the package 13. Once the package has left the contact zone, it is ejected by the brush 7 towards an upper region so as to follow a path that is substantially circular, during which it flies over the brush 7 and strikes the cylindrical drum 4 prior to being captured once again by the brush that takes it into the contact zone in order to be subjected therein once more to intense brushing. Each time it flies away from the contact zone, the package being processed loses an additional portion of the materials adhering to its surface, which materials are centrifuged when the package passes over the brush while spinning.

While processing packages containing waste that is stringy—such as meat or pineapple—or that can clump together, easily such as semolina, plugs form that obstruct the orifices in the drum (which is said to be "clogged" with material). It is then necessary to proceed frequently with operations for unclogging the drum. Such operations require access to the inside of the drum and they require the obstructed orifices to be cleaned one by one, which makes it necessary to begin by emptying the drum. Machine downtime is considerable and unclogging operations have a significant impact on the cost of operating the machine.

OBJECT OF THE INVENTION

The object of the invention is to reduce the time and/or the cost of unclogging a processor apparatus for collecting material adhering to a package surface.

SUMMARY OF THE INVENTION

To this end, there is provided processor apparatus for collecting material adhering to surfaces of packages for processing as waste, the processor apparatus comprising a cylindrical drum that is rotatable about a longitudinal axis and that is provided with orifices to form a screen that retains the packages while allowing the material for collecting to pass through; and motor means for driving the rotary drum in rotation. According to the invention, the processor apparatus also includes unclogging means for at least partially unobstructing the orifices while the cylindrical drum is rotating. Thus, the orifices are unclogged while the drum is rotating and the downtime of the processor apparatus for unclogging purposes is reduced, thereby improving the profitability of the processor apparatus.

A device is obtained that is particularly robust when the unclogging means comprise a wheel mounted to rotate about a first axis and provided with at least one radially projecting element for engaging in an orifice of the drum.

The device is particularly reliable when the first axis is substantially parallel to the longitudinal axis.

The volume of waste that can be loaded into the drum is increased when the wheel is mounted outside the cylindrical drum.

The wheel is particularly inexpensive to construct when the wheel comprises at least one disk mounted to rotate about the first axis or a plurality of spaced-apart disks mounted to rotate about the first axis.

Advantageously, each orifice is defined by four faces, with construction of the drum and of the wheel being simplified when the four faces are parallel in pairs.

When the radially projecting element is a tooth, the wheel can be constructed in simple manner, e.g. by oxyacetylene cutting a metal sheet. The unclogging of the orifices is more effective when the tooth has a height that is greater than the thickness of the cylindrical drum.

The drum can be constructed by welding together curved sheets when the wheel includes at least two successive radially projecting elements that extend along respective radial directions forming a first angle between them, and when the wheel also includes at least two successive radially projecting elements that extend along respective radial directions forming a second angle between them, the second angle being an integer multiple greater than one of the first angle.

Advantageously, the processor apparatus includes a comb having teeth that extend between successive pairs of disks of the wheel.

Waste is made easier to discharge when a package ejector is arranged to slide inside the drum along a direction substantially parallel to the longitudinal axis.

Also advantageously, the apparatus includes compression means for pressing against an inside face of the cylindrical drum and mounted in the cylindrical drum in the immediate vicinity of its inside surface, the compression means being motor driven so as to be caused to rotate about an axis substantially parallel to the longitudinal axis. The compression means then serve to guide the waste into a space that diminishes progressively as the waste approaches the wall of the drum. This ensures that the package and its content are pressed against the wall of the drum, and thus that the content is extracted from the package.

Advantageously, the packages are inserted into the cylindrical drum via a loading hopper having a loading opening and a feed opening facing a feed port leading into the cylindrical drum. Loading operations are made easier when the loading hopper is arranged on a frame of the processor apparatus to slide between a first position in which the feed opening is spaced apart from the feed port, and a second position in which the feed opening faces the feed port.

The performance of the machine with various different types of waste can easily be evaluated when the apparatus includes weighing means for weighing the hopper in its second position.

Other characteristics and advantages of the invention appear in the light of the following description of a non-limiting embodiment of the invention.

BRIEF DESCRIPTION OF THE FIGURES

The invention can be better understood on reading the following description of a particular, nonlimiting embodiment of the invention.

Reference is made to the accompanying drawings, in which.

DETAILED DESCRIPTION OF THE INVENTION

Figure 1:
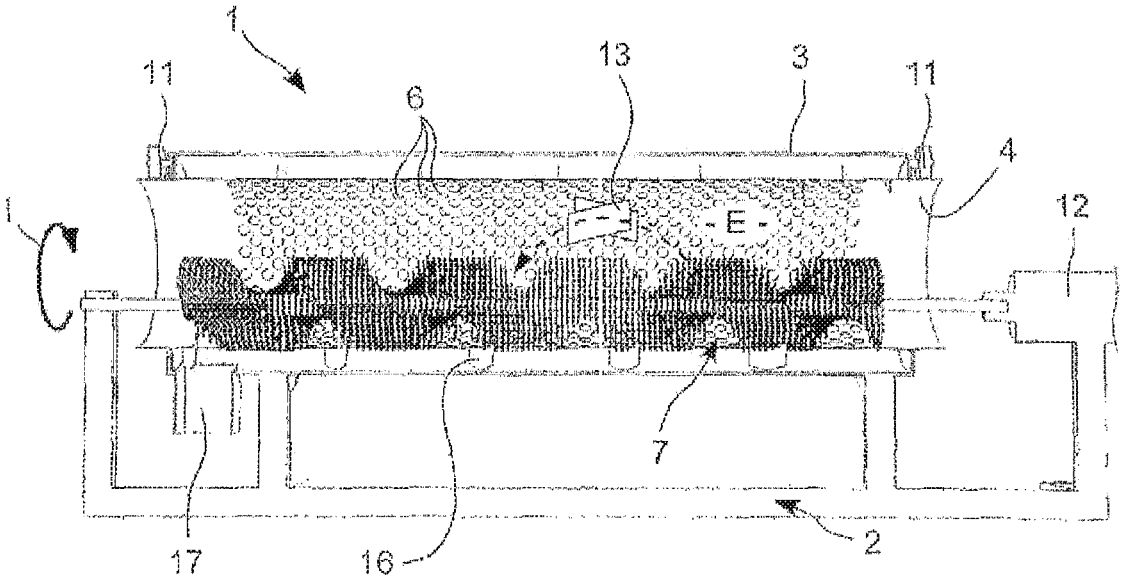
Fig. 1 (Prior art)
FIG. 1 is a diagrammatic view of the prior art apparatus, shown in longitudinal section and described above.
Figure 2:
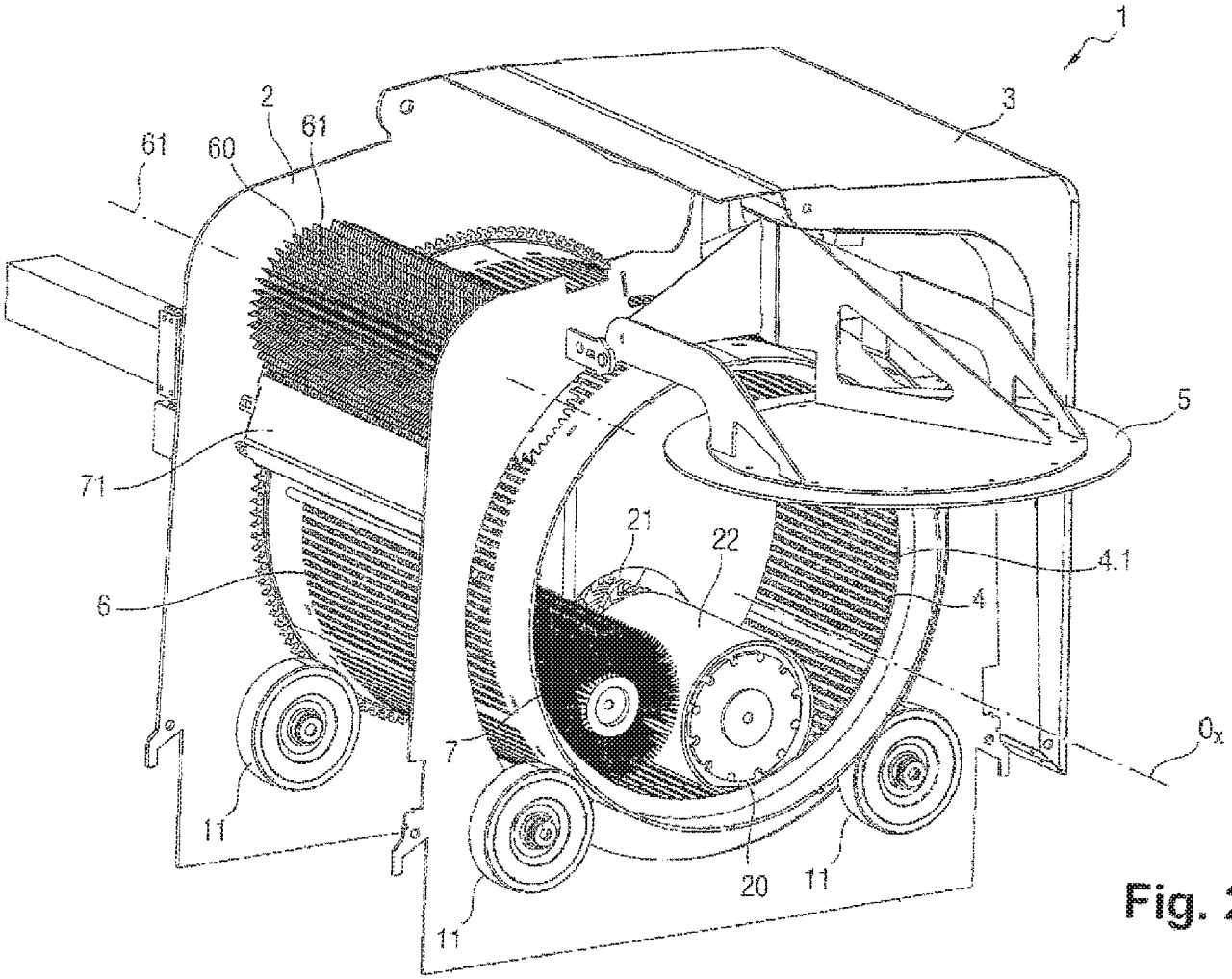
FIG. 2 is a fragmentary diagrammatic view in perspective of the apparatus of the invention, with the front of the apparatus being more particularly visible in the foreground.
Figure 3:
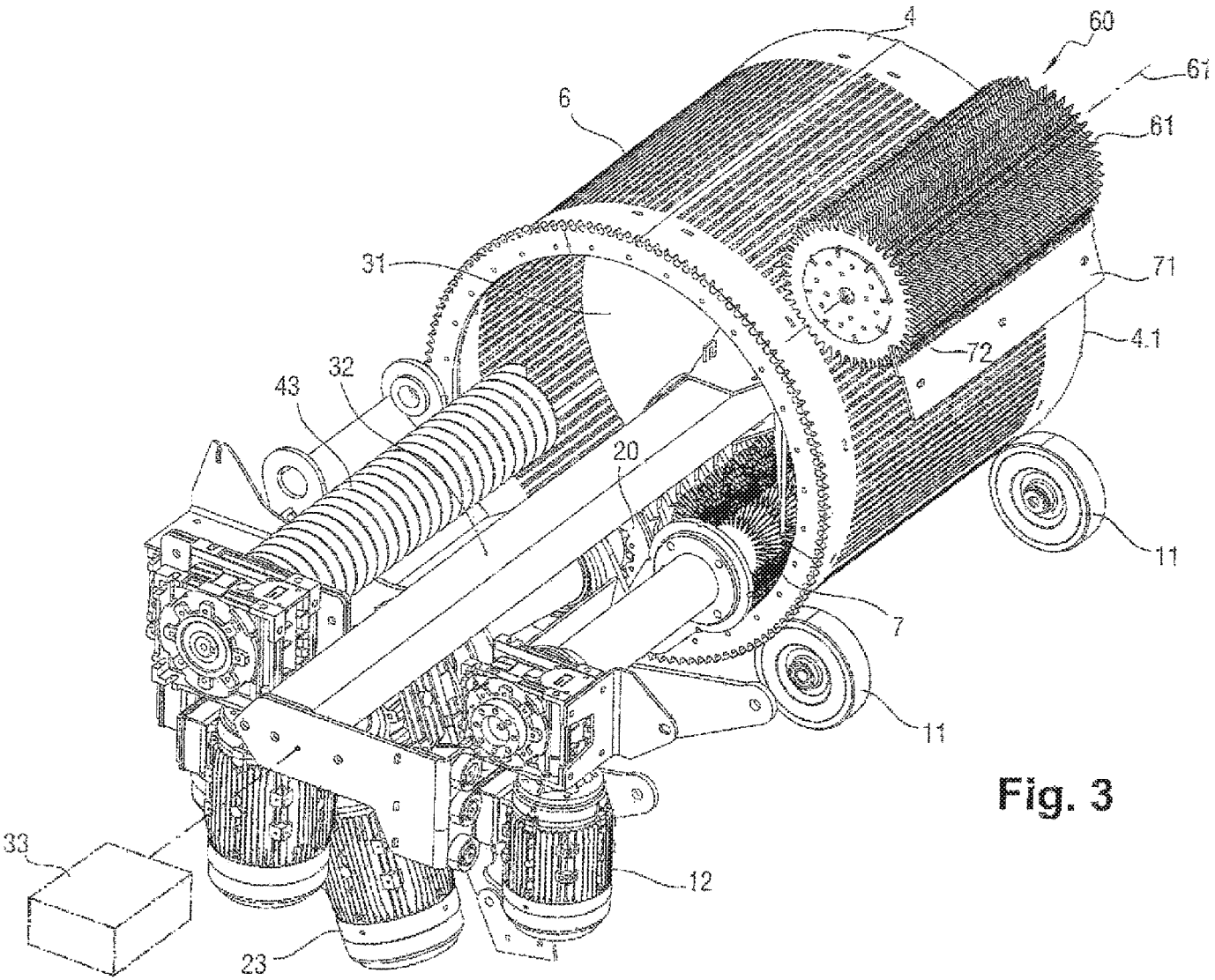
FIG. 3 is a fragmentary diagrammatic view in perspective of the apparatus of the invention, with the rear of the apparatus being more particularly visible in the foreground.
Figure 4:
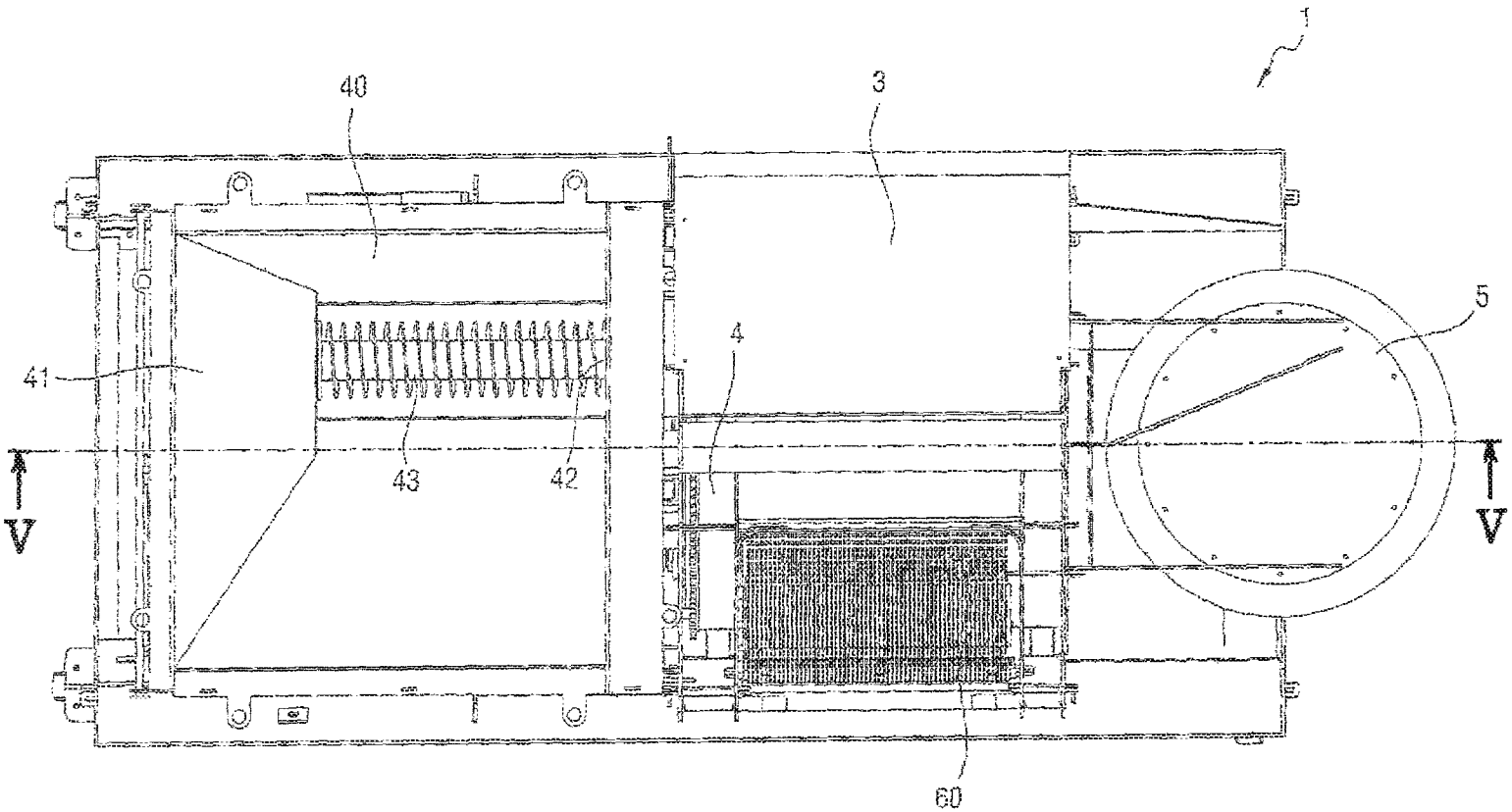
FIG. 4 is a diagrammatic plan view of the apparatus of the invention.
Figure 5:
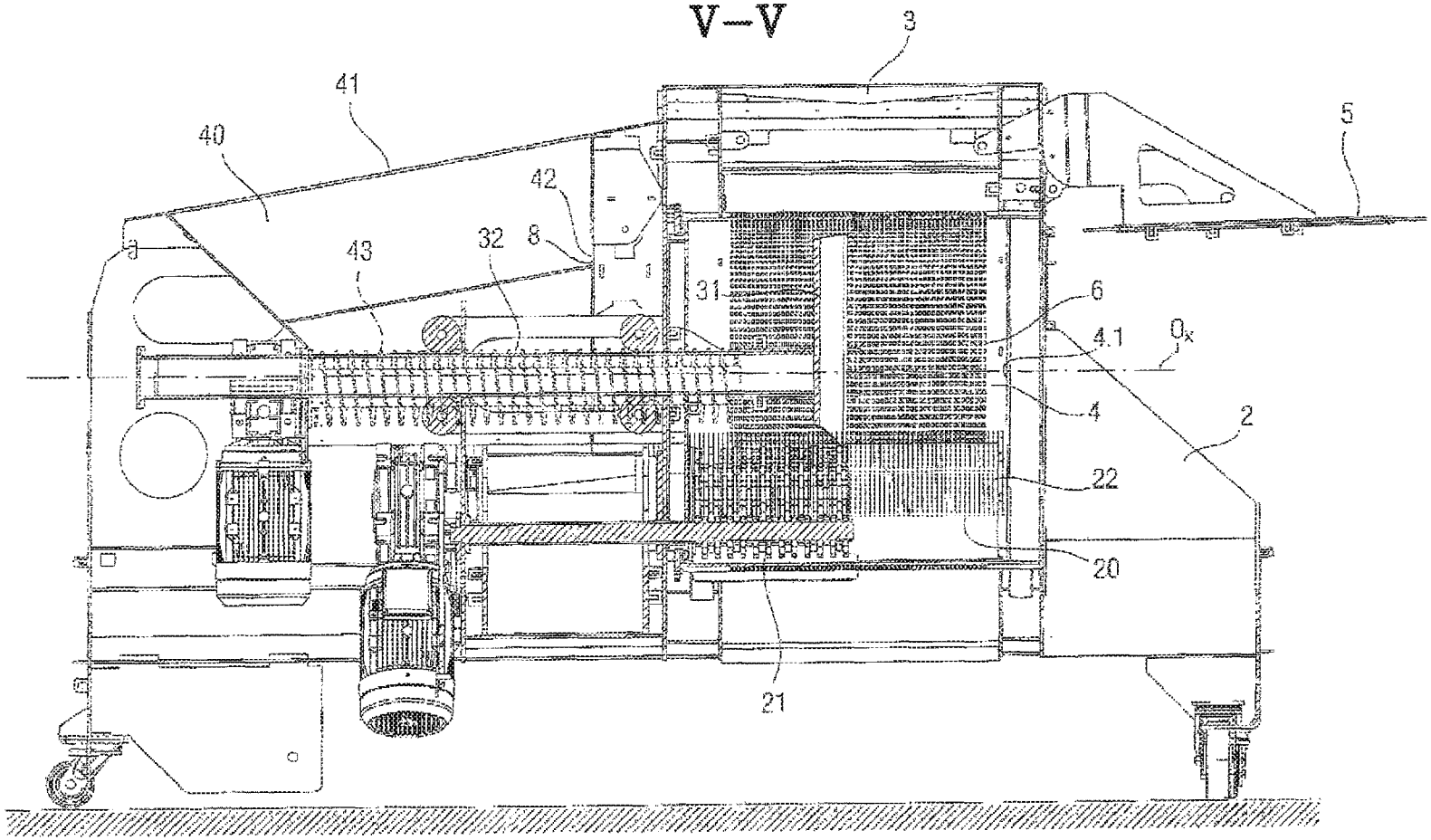
FIG. 5 is a diagrammatic longitudinal section view on a plane V-V of the apparatus of the invention.
Figure 6:
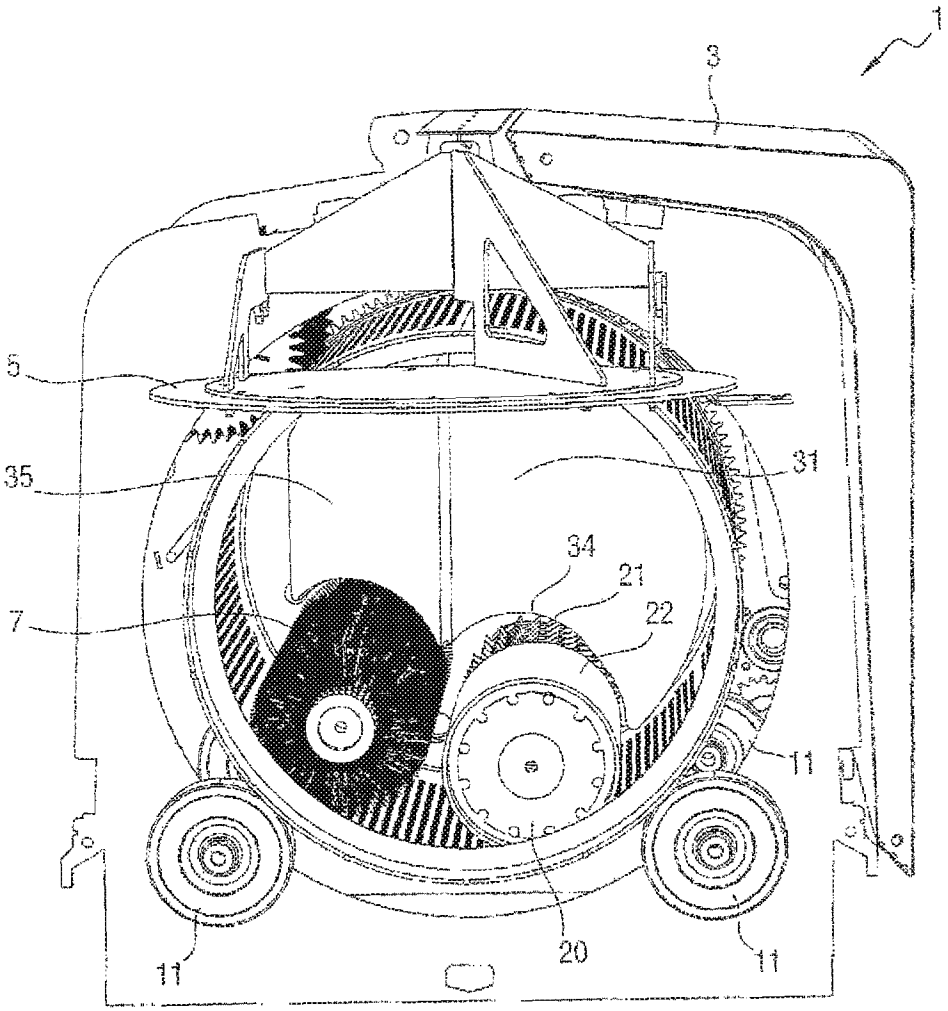
FIG. 6 is a diagrammatic front view of the apparatus of the invention.

With reference to FIGS. 2 to 6, the processor apparatus of the invention, given reference 1, includes a frame 2 in the form of a structure made up of machine-welded steel bars and carrying a hinged casing 3 made of steel (with the casing 3 being shown in part only for reasons of clarity).

The casing 3 contains a cylindrical drum 4 or "trommel" 4 in the form of a sheet-metal cylinder perforated by a series of orifices 6 over the great majority of its surface so as to constitute a screen that is rotatable about a longitudinal axis Ox. A door 5 hinged about a horizontal axis perpendicular to the longitudinal axis Ox serves to close the first end 4.1 of the trommel 4. A rotary cylindrical brush 7 and a roller 20 are mounted inside the trommel 4. The trommel 4 also contains a package ejector 30 in the form of a disk 31 connected to a rod 32 of a piston 33, the rod 32 being mounted to slide inside the trommel 4 along a direction that is substantially parallel to the longitudinal axis Ox. The disk 32 includes a cutout 34 to avoid the brush 7 and a flap 35 that receives packages thrown out by the brush 7 against the flap 35, and directs them towards the first end 4.1 of the trommel 4, thereby directing the packages towards the outlet of the trommel 4.

Figure 7:
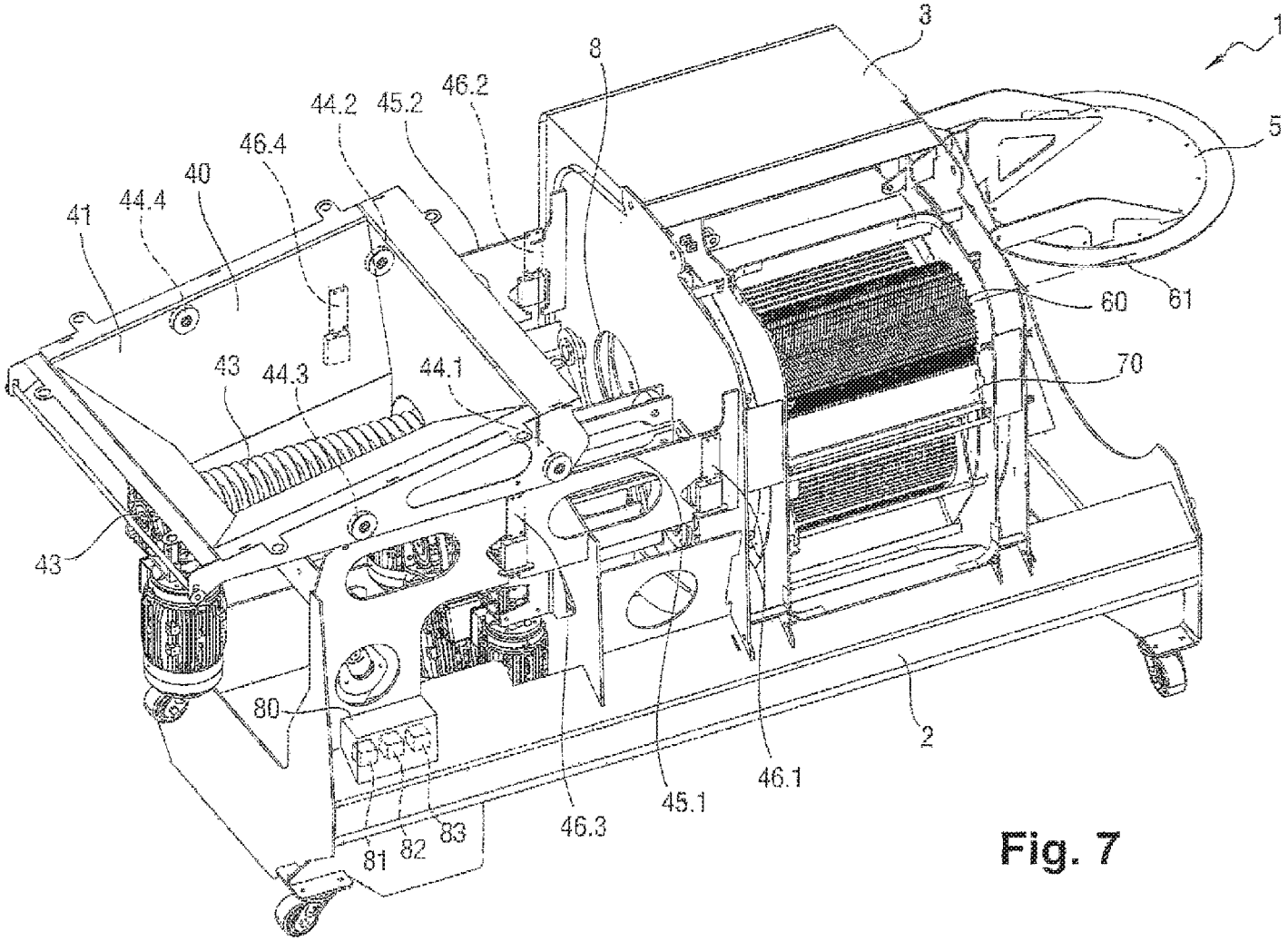
FIG. 7 is a diagrammatic perspective view of the apparatus of the invention, showing the screen in a first position.
Figure 8:
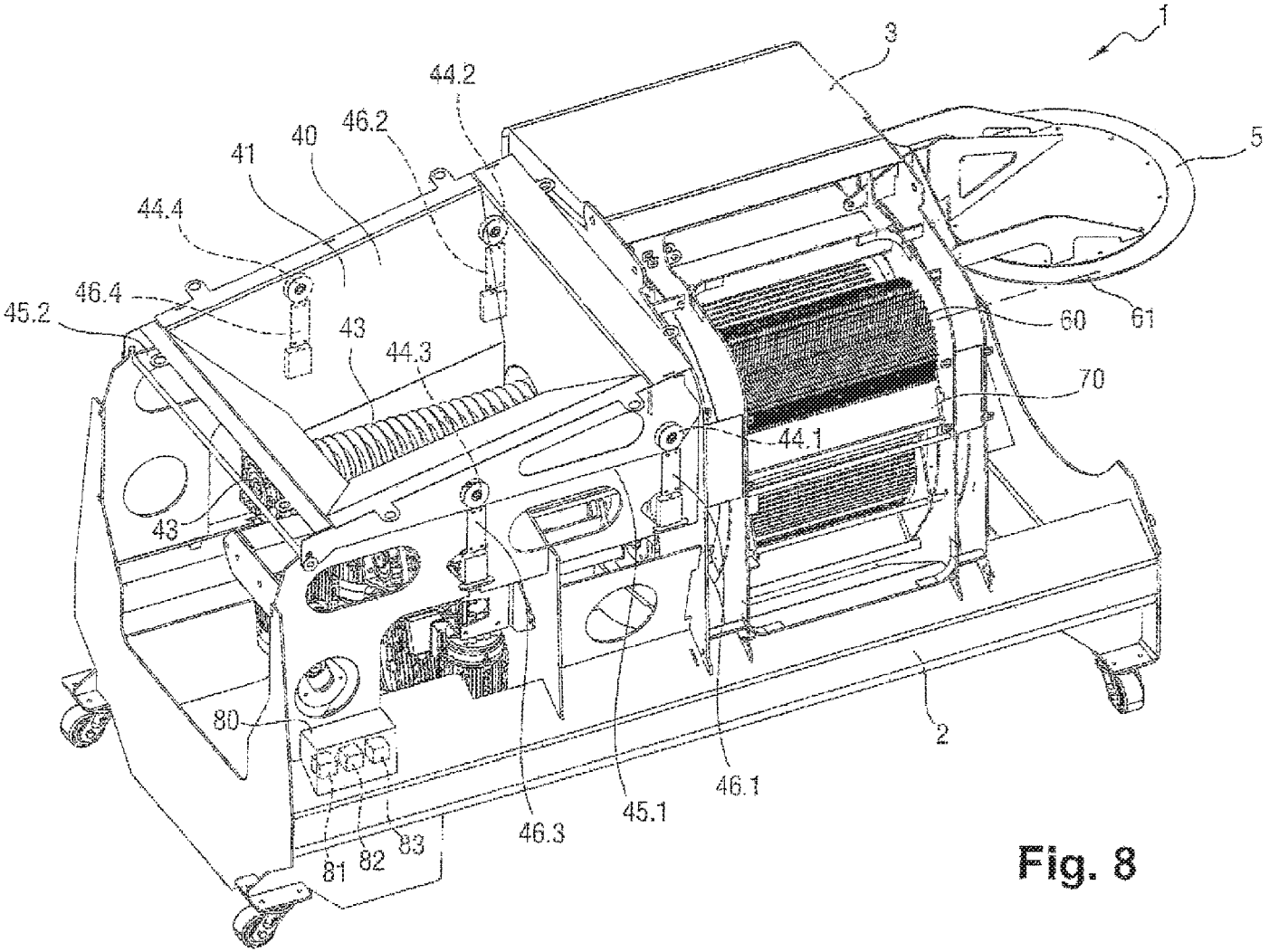
FIG. 8 is a view analogous to FIG. 6, showing the screen in a second position.

A hopper 40 substantially in the shape of an upside-down pyramid has a loading opening 41 and a feed opening 42 facing a feed port 8 leading into the trommel 4. A motor-driven worm screw 43 extends inside the hopper 40 in order to direct packages 13 towards the feed opening 42 so as to feed the trommel 4 with waste. The hopper 40 has four wheels 44.1 to 44.4 located in the proximity of the corners of the loading opening 41 of the hopper 40. These wheels 44.1 to 44.4 co-operate with first and second rails 45.1 and 45.2 that are secured to the frame 2 so that the hopper 40 can slide between a first position (shown in FIG. 7) and a second position (shown in FIG. 8). In the first position of the hopper 40, the feed opening 42 of the hopper 40 is spaced apart from the feed port 8. In its second position, the feed opening 42 of the hopper 40 faces the feed port 8, and each of the wheels 44.1 to 44.4 stands on a respective piezoresistive strain gauge 46.1 to 46.4. The trommel 4 is driven in rotation about the longitudinal axis Ox by means of a motor (not shown in figures) and it is guided at each of its ends by two guide wheels 11. The brush 7 is driven in rotation by a motor 12 that is carried by the frame 2, at one of the ends of the apparatus 1. The speed of rotation of the brush 7 is preferably much faster than the speed of rotation of the trommel 4.

The rotor 20 is driven in rotation about an axis that is substantially parallel to the longitudinal axis Ox by a motor 23 and it serves to improve the recovery of material contained in the packages. The roller 20, which is generally cylindrical in shape, is mounted inside of the trommel 4 in order to roll on the inside surface of the trommel 4. The roller 20, which can be seen more clearly in FIGS. 5 and 6, comprises two successive segments along its length: a first segment referred to as a "depackaging segment" 21 has an outside surface that bristles with spikes so as to extract materials from the packages, and possibly so as to shred the packages, and a second segment, referred to as a "flattening segment" 22, has an outside surface that is smooth and that is arranged to force materials for collecting through the trommel 4.

The piezoresistive strain gauges 45.1 to 45.4, the motor drive of the trommel 4, the motor 12 of the brush 7, the motor 23 of the compression roller, the piston 33, the motor drive of the worm screw 43, and other electrical equipment (detector for detecting closure of the door 5 etc.) are all connected to a control unit 80 of the processor apparatus 1, which unit is provided with a memory 81, a touch display 82, and wireless communication means 83 (specifically a Wi-Fi interface).

Figure 9:
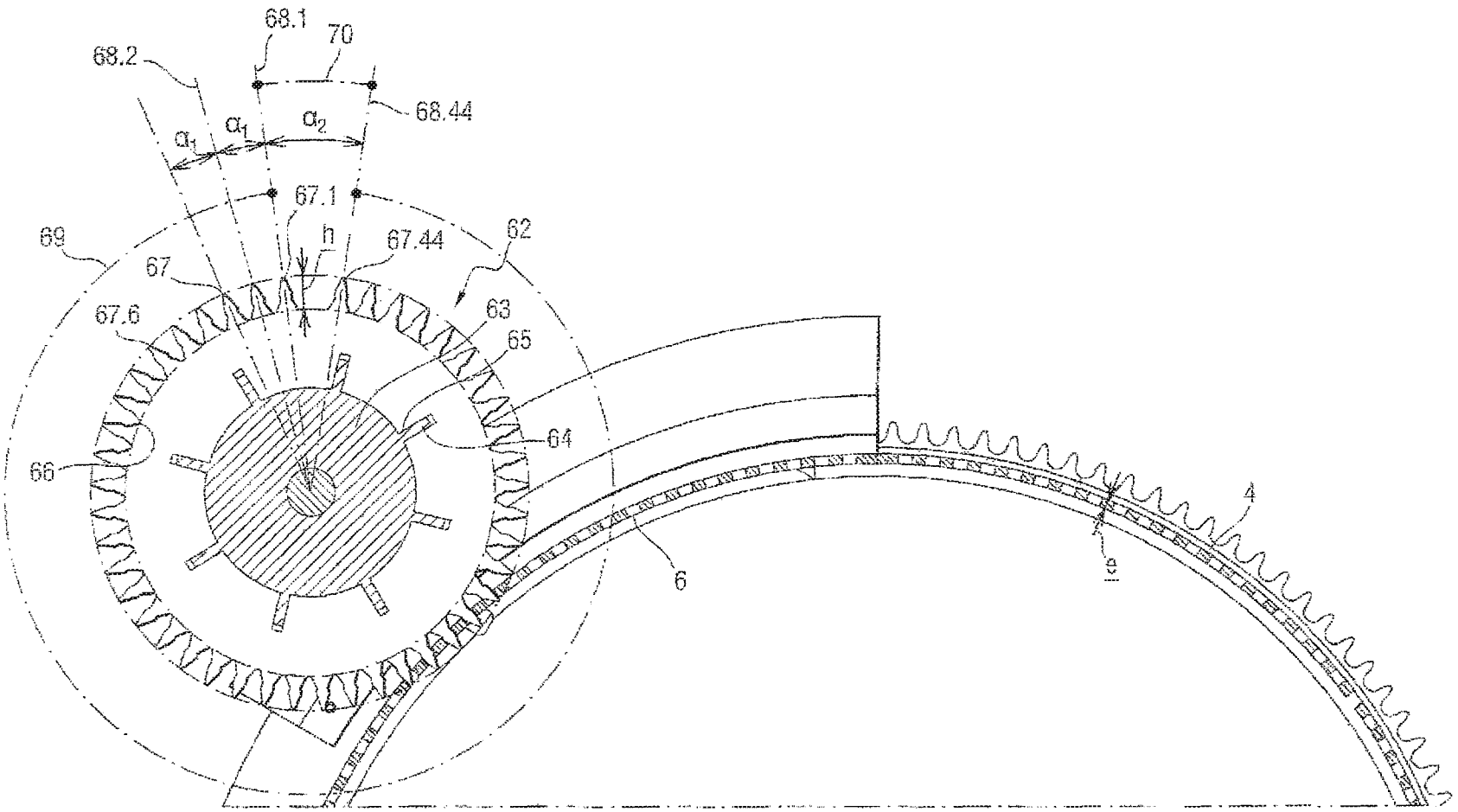
FIG. 9 is a detailed view of the apparatus of the invention.
Figure 10:
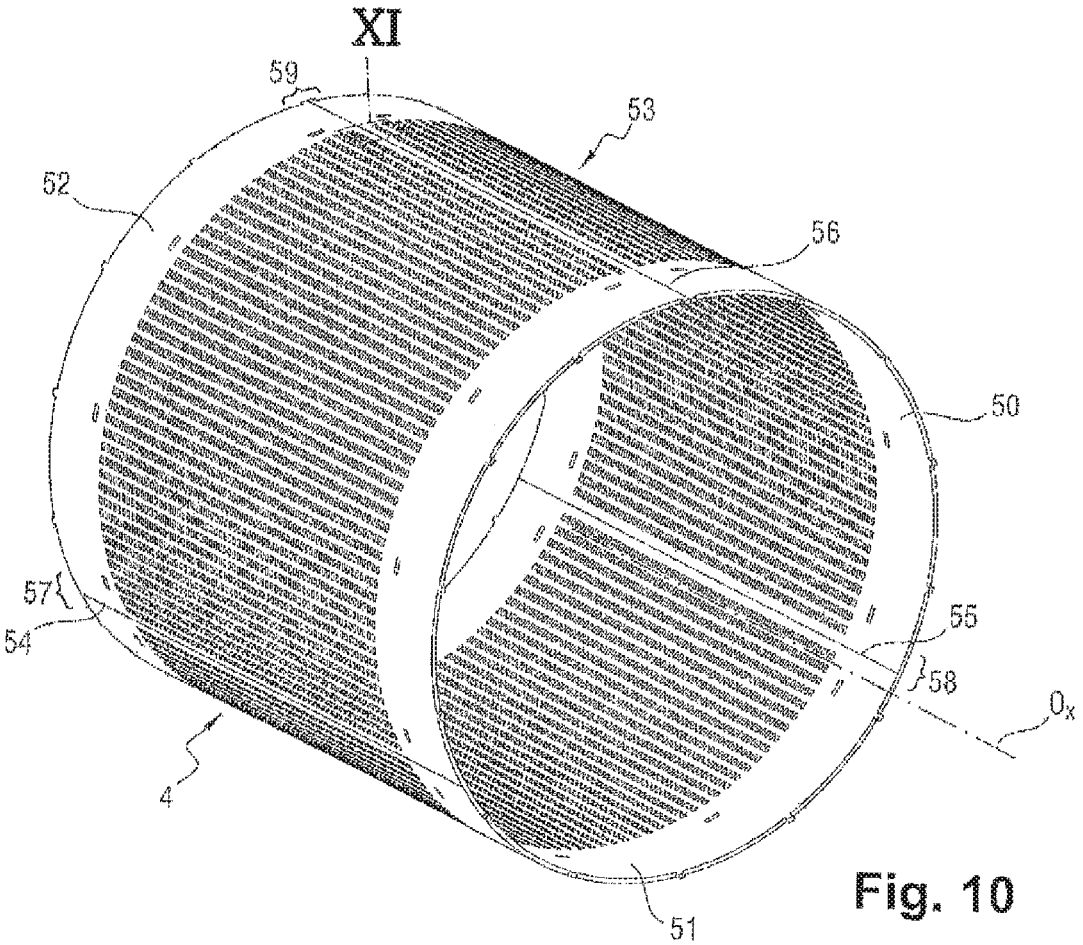
FIG. 10 is a diagrammatic perspective view of the drum of the apparatus of the invention.
Figure 11:
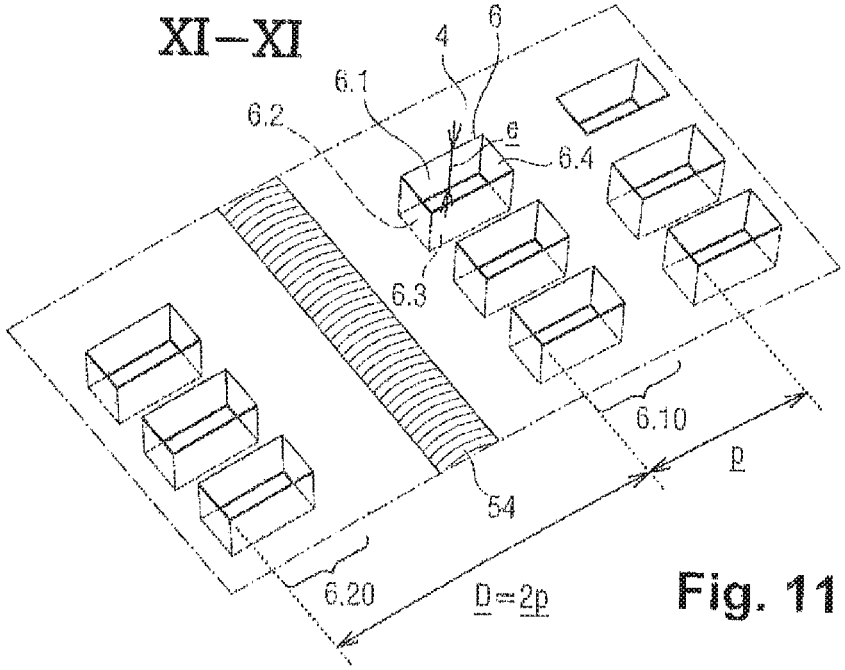
FIG. 11 is a diagrammatic perspective view a detail of the drum of the apparatus of the invention.

As can be seen in FIGS. 9 to 11, the orifices 6 in the trommel 4 are substantially rectangular in section, and each of them is defined by four faces 6.1, 6.2, 6.3, and 6.4 that are parallel in pairs. Thus, the faces 6.1 and 6.3 are parallel to each other and they extend in respective planes that are substantially orthogonal to the longitudinal axis Ox. The faces 6.2 and 6.4 extend in planes that contain the longitudinal axis Ox. In this example, the trommel 4 is made up from three sheets 50, 51, and 52 of high elastic limit S700 steel and of thickness e. The sheets 50, 51, and 52 are initially curved prior to being welded together to make a cylinder 53 having three longitudinal welds 54, 55, and 56. The cylinder 53 is then placed in a high-pressure water-jet cutter machine in order to make the orifices 6. The orifices 6 are positioned relative to one another with accuracy of about 0.2 millimeters. The orifices 6 are of a section that is preferably in the shape of a quadrilateral, with short sides having dimensions lying in the range five millimeters to eight millimeters and long sides having dimensions lying in the range eight millimeters to twelve millimeters. Sections of five millimeters by eight millimeters and of eight millimeters by twelve millimeters are most preferred. The orifices 6 are made in the screen 4 at a pitch p lying in the range nine millimeters to eighteen millimeters. As can be seen in FIG. 10, the longitudinal welds 54, 55, and 56 do not include orifices 6. Thus, the longitudinal series 6.10 and 6.20 of orifices 6 that are situated on either side of the weld 54 are spaced apart by a distance D that is equal to twice the pitch p. The trommel 4 shown in FIG. 10 has a diameter of about eight hundred millimeters and it includes fifty rows of one hundred and thirty-two orifices 6. The one hundred and thirty-two orifices 6 are arranged in three sectors of forty-four orifices 6 each that are made in the sheets 50, 51, and 52. These three sectors are spaced apart from one another by first, second, and third zones 57, 58, and 59 in which the longitudinal welds 55, 55, and 56 lie respectively.

The processor apparatus 1 includes means for unclogging the orifices 6 during rotation of the trommel 4, which means, in this example, are in the form of a wheel 60 mounted to rotate about a first axis 61 that extends substantially parallel to the longitudinal axis Ox. The wheel 60 comprises fifty identical disks 62 that are spaced apart from one another by spacers. Each disk 62 is constrained to rotate with a splined shaft 63, and it possesses radial slots 64 co-operating with the splines 65 of the shaft 63. Each disk 62 has a root cylinder 66 having projecting therefrom teeth 67 of height h, which in this example is greater than the thickness e of the trommel 4.

As can be seen in FIG. 9, the disk 62 has forty-four teeth 67.1 to 67.44, each extending along a respective radial direction 68.1 to 68.44. Each radial direction 68.1 to 68.44 of the forty-four first teeth 67 extends relative to the next at a first angle $\alpha_1$ equal to eight degrees, thereby covering an angular sector of three hundred and forty-four degrees. The disk 62 also has a forty-fourth tooth 67.44 and a first tooth 67.1 in succession, for which the respective forty-fourth and first radial directions 68.44 and 68.1 form a second angle $\alpha_2$ equal to sixteen degrees. The wheel 60 thus possesses a meshing angular sector 69 and a second or "escape" angular sector 70 covering the second angle $\alpha_2$. In this example, the value of the angle $\alpha_2$ is twice the value of the angle $\alpha_1$.

The wheel 60 is mounted outside the trommel 4 so that the teeth 67 of each of the disks 62 co-operates with the orifices 6 in the trommel 4 in the same manner as two gear wheels.

A comb 71 secured to the frame 2 is placed in the proximity of the wheel 60 so that the teeth 72 of the comb extend between successive pairs of disks 62 of the wheel 60.

In operation, the user brings the hopper 40 into its first position, and loads it with packages 13 via its loading opening 41. Once the hopper 40 is loaded, the user pushes it into its second position. The piezoresistive strain gauges 46.1 to 46.4 transmit to the control unit 80 respective electrical signals representative of the loads to which they are subjected. The control unit 80 deduces therefrom of the weight of packages 13 loaded in the hopper 40, stores this weight in the memory 81, and displays it on the display 82. Optionally, this quantity is transmitted by the wireless communication means 83 to a remote server. The control unit 80 causes the trommel 4, the brush 7, and the rotor 20 to be set into rotation. The control unit 80 then causes the worm screw 43 to the put into operation until a determined quantity of packages 13 is inserted into the trommel 4—as can be measured by using the piezoresistive strain gauges 46.1 to 46.4. Rotation of the trommel 4 causes the wheel 60 to rotate and the teeth 67.1 to 67.44 to be inserted into the orifices 6 while the trommel 4 is rotating. Since the ratio of the pitch diameters of the wheel 60 and of the trommel 4 is an integer (which ratio is 3 in this example), the wheel 60 always presents the escape sector 70 in register with the welds 54, 55, and 56, thereby avoiding any collision between a tooth 67 and any one of the welds 54, 55, or 56. The clogging material ejected from the orifices 6 by the teeth 67 drops into the trommel 4, where the brush 7 and the roller 20 break it up and discharge it through the orifices 6.

The packages 13 may be discharged from the trommel 4 in various ways. Depending on the degree of dirtying of the packages 13, the processor apparatus 1 may operate with the door 5 fully or partially open, with the packages 13 being discharged progressively as they are processed. It is also possible to close the door 5 while the packages 13 are being processed, and then, after a predefined processing duration, to open the door 5 and actuate the jack 33 so as to cause the package ejector 31 to be extended so as to slide into the inside of the trommel 4 and push the packages 13 out from the trommel 4 via the first end 4.1. The control unit 80 can then be actuated to operate the worm screw 43 in order to reload the trommel 4.

The dimensions of the orifices 6 in the drum 4 are selected to retain the packages 13, while allowing the materials that they contain and that adhere to the packages 13 to pass through. The passage of the materials in question is made even easier by the centrifugal effect of the trommel 4 rotating, with these materials then being found in the casing 3, while the packages 13 are retained inside the trommel 4.

Naturally, the invention is not limited to the embodiment described and covers any variant coming within the ambit of the invention as defined by the claims.

In particular, although in this example waste is compressed by a cylindrical roller that is rotatably mounted, the invention applies equally well to other compression means, e.g. such as a stationary cylindrical roller, a stationary plane scraper positioned to form an acute angle with the inside surface of the drum, or a stationary metal sheet of cross-section that is substantially comma-shaped. Such a scraper or such a sheet could present a portion provided with claws (depackaging first function) and a second portion for guidance (flattening). More generally, the compression means serve to guide the waste into a space that diminishes progressively as the waste approaches the inside surface of the drum. The compression means of the invention may equally well comprise a compression cone having its axis of rotation optionally parallel to the axis of rotation of the drum, or it may comprise a cylinder of octagonal or any section.

The compression means may equally well be arranged to perform other processing functions, optionally in addition to the above-mentioned functions. In the above-described roller, it is possible for there to be a third segment provided with bristles similar to the bristles of the brush.

Although in this example the unclogging means comprise a wheel with teeth, the invention applies equally to other means for unclogging the drum while it is rotating, e.g. such as high-pressure injection of water, of air, or of shot striking the drum.

Although in this example the casing is made of steel, the invention applies equally to other materials for making the casing, such as stainless steel, other types of metal, synthetic materials, or carbon or glass fibers.

Although in this example the package ejector is actuated by a piston, the invention applies equally to other ways of actuating the package ejector, e.g. such as actuation of that is manual of pneumatic.

Although in this example the processor apparatus has piezoelectric strain gauges, the invention applies to other types of weighing means such as for example fluid pressure sensors, a Wheatstone bridge, or a sensor for sensing movement of a pre-stressed element.

Although in this example the apparatus includes a brush and compression means, the invention applies equally well to apparatus that does not include a brush and/or that does not include compression means, and in which the material for connecting is separated from the surfaces of the waste by a centrifugal and agitation effect.

Although in this example the drama is made by welding together three curved sheets of S700 steel, the invention applies equally well to making the drum in other ways, such as for example a drum made from one, two, or more than three curved sheets, which may be made of other grades of steel, e.g. such as steels that are particularly resistant to abrasion, of the Hardox® or Z120M12 type.

Although in this example the orifices situated on either side of a weld are spaced apart by a distance that is equal to twice the pitch at which the orifices are laid out, the invention applies equally well to orifices situated on either side of a weld that are spaced apart by a distance that is less than or greater than twice the layout pitch, and that is preferably proportional to an integer multiple of the orifice layout pitch.

Although in this example the wheel has forty-four projecting teeth, the invention applies equally well to unclogging means having one to forty-three teeth or indeed more than forty-four teeth. The wheel could have projecting elements of some other type, e.g. such as brushes or portions of cylinders.

Although in this example the wheel comprises a plurality of spaced-apart disks, the invention applies equally well to a wheel comprising a single-piece structure obtained by molding or by machining a block.

Although in this example the wheel is mounted outside the drum, the invention applies equally well to a wheel mounted inside the drum.

The invention claimed is:

1. A processor apparatus for collecting material adhering to surfaces of packages for processing as waste, comprising:

a cylindrical drum that is rotatable about a longitudinal axis and that is provided with orifices to form a screen that retains the packages while allowing the material for collecting to pass through;

motor means for driving the cylindrical drum in rotation; and unclogging means for at least partially unobstructing the orifices while the cylindrical drum is rotating, the unclogging means comprising a wheel mounted to rotate about a first axis, the wheel comprising:

at least two successive radially projecting elements, for engaging in an orifice of the cylindrical drum, that extend along respective radial directions forming a first angle between them; and at least two successive radially projecting elements, for engaging in an orifice of the cylindrical drum, that extend along respective radial directions forming a second angle between them, the second angle having a value N times greater than a value of the first angle, N being an integer greater than 1.

2. The processor apparatus according to claim 1, wherein the first axis is parallel to the longitudinal axis.

3. The processor apparatus according to claim 1, wherein the wheel is mounted outside the cylindrical drum.

4. The processor apparatus according to claim 1, wherein the wheel comprises at least one disk mounted to rotate about the first axis.

5. The processor apparatus according to claim 4, wherein the wheel comprises a plurality of spaced-apart disks mounted to rotate about the first axis.

6. The processor apparatus according to claim 1, wherein each orifice is defined by four faces.

7. The processor apparatus according to claim 6, wherein the four faces are parallel in pairs.

8. The processor apparatus according to claim 1, wherein the each of the plurality of radially projecting elements is a tooth.

9. The processor apparatus according to claim 8, wherein the tooth has a height that is greater than the thickness of the cylindrical drum.

10. The processor apparatus according to claim 8, further comprising a comb having teeth that extend between successive pairs of disks of the wheel.

11. The processor apparatus according to claim 1, further comprising a package ejector arranged to slide inside the cylindrical drum along a direction parallel to the longitudinal axis.

12. The processor apparatus according to claim 1, further comprising compression means for pressing against an inside face of the cylindrical drum and mounted in the cylindrical drum in the immediate vicinity of its inside surface, the compression means being motor driven so as to be caused to rotate about an axis parallel to the longitudinal axis.

13. The processor apparatus according to claim 1, wherein the packages are inserted into the cylindrical drum via a loading hopper having a loading opening and a feed opening facing a feed port leading into the cylindrical drum.

14. The processor apparatus according to claim 13, wherein the loading hopper is arranged on a frame of the processor apparatus to slide between a first position in which the feed opening is spaced apart from the feed port, and a second position in which the feed opening faces the feed port.

15. The processor apparatus according to claim 14, wherein the processor apparatus includes weighing means for weighing the hopper in its second position.

* * * * *